US005819314A

United States Patent [19]

Jackson

[11] Patent Number: 5,819,314

[45] Date of Patent: Oct. 13, 1998

[54] BIB HAVING CONCAVE SIDE EDGES

[75] Inventor: Beverly Ann Julian Jackson, Hamilton, Ohio

[73] Assignee: The Procter & Gamble Company, Cincinnati, Ohio

[21] Appl. No.: 963,228

[22] Filed: Nov. 3, 1997

Related U.S. Application Data

[63] Continuation of Ser. No. 733,377, Oct. 17, 1996, abandoned.

[51] Int. Cl.[6] ..... A41C 13/00; A41D 27/00

[52] U.S. Cl. ..... 2/49.2; 2/243.1; 2/48

[58] Field of Search ..... 2/46, 48, 49.1, 2/49.2, 49.3, 49.4, 49.5, 50, 51, 52, 243.1, 75, 80, 83, 69, 69.5, 247, 248, 249, 250, 251, 252; D2/860, 861, 862, 863, 864

[56] References Cited

U.S. PATENT DOCUMENTS

| | | | |
|---|---|---|---|
| D. 237,557 | 11/1975 | Brosk | D2/864 |
| 298,985 | 5/1884 | Kimball . | |
| D. 381,190 | 7/1997 | Deon | D2/864 |
| 699,513 | 5/1902 | Garms | 2/52 |
| 1,970,307 | 8/1934 | Hartmann | 2/48 |
| 2,136,983 | 11/1938 | Quinn | 2/48 |
| 2,164,369 | 7/1939 | Woolever | 2/49 |
| 2,424,000 | 7/1947 | Shanker | 2/52 |
| 2,424,680 | 7/1947 | Doyle | 2/49 |
| 2,468,841 | 4/1949 | Siegel | 2/51 |
| 2,469,835 | 5/1949 | McMartin | 2/49.1 |
| 2,552,462 | 5/1951 | Savrin | 2/49 |
| 2,567,524 | 9/1951 | Morganti | 2/48 |
| 2,648,845 | 8/1953 | Berman | 2/48 |
| 2,704,625 | 3/1955 | Huse | 2/49 X |
| 2,884,638 | 5/1959 | Ream | 2/48 |
| 3,093,829 | 6/1963 | Maine | 2/48 |
| 3,286,279 | 11/1966 | Brown | 2/49 |
| 3,407,407 | 10/1968 | Hollander | 2/49 |
| 3,871,027 | 3/1975 | Orr | 2/49 R |
| 4,416,025 | 11/1983 | Moret et al. | 2/49 R |
| 4,441,212 | 4/1984 | Ahr et al. | 2/49 R |
| 4,445,231 | 5/1984 | Noel | 2/49 R |
| 4,475,250 | 10/1984 | Savrin et al. | 2/49.1 |
| 4,495,658 | 1/1985 | Moret et al. | 2/49 R |
| 4,523,333 | 6/1985 | Spangler | 2/49 R |
| 4,523,334 | 6/1985 | Lavash | 2/49 R |
| 4,649,572 | 3/1987 | Roessler | 2/49.2 |
| 4,660,224 | 4/1987 | Ashcraft | 2/48 |
| 4,846,822 | 7/1989 | Foxman | 604/370 |
| 4,891,846 | 1/1990 | Sager et al. | 2/49 R |
| 4,951,318 | 8/1990 | Harreld et al. | 2/48 |
| 5,493,734 | 2/1996 | Nieves-Rivera | 2/209.13 |

FOREIGN PATENT DOCUMENTS

| | | | |
|---|---|---|---|
| 600109 | 6/1960 | Canada . | |
| 001193862 | 11/1959 | France | 2/49.1 |

OTHER PUBLICATIONS

Gershman, Maurice, "Self Adhering Nylon Tapes." The J.A.M.A, vol. 168, No. 7, p. 930, Oct. 1958.

U.S. Patent Application Serial No. 08/513,496, Bib Having an Improved Pocket, Richard N. Reinhart, Jr., filed Aug. 10, 1995.

U.S. Patent Application Serial No. 08/513,643, Bib Having an Improved Neck Opening, Richard N. Reinhart; Jr., filed Aug. 10, 1995.

U.S. Patent Application Serial No. 60/002,095, Bib Having an Improved Fastener, Richard N. Reinhart, Jr., filed Aug. 10, 1995.

U.S. Patent Application Serial No. 08/667,155, Bib Having an Improved Fastener, Richard N. Reinhart, Jr., file Jun. 20, 1996.

Copy of packaging & 1 sample, Playskool Barney Disposable Bibs.

Copy of packaging & 1 sample, Crumples Disposable Bibs.

*Primary Examiner*—Jeanette E. Chapman

*Attorney, Agent, or Firm*—Jay A. Krebs; Larry L. Huston; Gerry S. Gressel

[57] ABSTRACT

The present invention provides a bib having a generally longitudinally symmetric and laterally asymmetric neck opening, and concave side edges. The generally planar neck opening can be teardrop shaped. The concave side edges accommodate movement of the wearer's arms. The bib can also include waist fastening members.

9 Claims, 4 Drawing Sheets

BIB HAVING CONCAVE SIDE EDGES

This is a continuation of application Ser. No. 08/733,377, filed on Oct. 17, 1996, now abandoned.

FIELD OF THE INVENTION

The present invention is related to disposable bibs, and more particularly, to a bib having a shape to promote improved fit.

BACKGROUND OF THE INVENTION

Disposable bibs are well known in the art. Such bibs can be provided for use on babies during feeding. Disposable bibs can have a laminate construction comprising multiple layers.

One problem with securing a bib to wearer is that, in fastening the bib to the wearer, the portion of the bib covering the wearer's chest can become distorted, thereby causing the bib to gap away from the wearer's chest. This distortion can be caused by the forces applied to the bib in securing the bib about the wearer's neck. Additionally, the portion of the bib over the wearer's chest can be distorted when the wearer's arms move, such as during feeding of the wearer. Such distortion is undesirable, because it can leave a portion of the wearer unprotected from food spills, and can cause undue discomfort to the wearer.

For instance, bibs which are mass produced with a common neck opening configuration may not fit all neck sizes and shapes equally well. As the bib neck opening configuration is made to conform to a wearer's particular neck size and shape, the portion of the bib over the wearer's chest can be distorted. On the other hand, if a an oversized bib neck opening configuration is not conformed to the wearer's neck during use, the bib can slip or shift on the wearer during use.

Accordingly, one object of the present invention is to provide a bib having a shape which conforms to the wearer's body while accommodating movement of the wearer.

Another object of the invention is to provide a bib having a neck opening and side edges which reduce distortion of the bib when the bib is secured to the wearer.

SUMMARY OF THE INVENTION

The present invention is a disposable bib having a longitudinal length, a lateral width, a bottom edge, and laterally spaced apart sides.

The sides comprise oppositely facing concave edges for accommodating movement of the wearer's arms. The bib also includes a pair of shoulder extensions extending from the bib body. The shoulder extensions extend from the bib body such that the inward edges of the shoulder extensions provide a generally planar neck opening which is generally symmetric about a longitudinal axis and generally asymmetric about a lateral axis passing through the midpoint of the longitudinal length of the neck opening. The concave sides, in combination with the neck opening, provide fit and conformance of the bib over the wearer's chest while accommodating movement of the wearer.

The shoulder extensions can extend from the bib body to provide a pair of oppositely facing, convex edges. Each convex edge can be positioned adjacent one of the concave edges. The portions of the bib bordered by the convex edge protect the wearer's shoulders from spills.

The bib can also include at least one waist fastening member. For instance, the bib can include a pair of waist fastening members, such as waist fastening straps, extending from opposite sides of the bib. The fastening members extend from the sides of the bib intermediate the bottom edge of the bib and the oppositely facing concave edges of the bib. If the bib includes a pocket, the fastening members preferably extend from the opposite sides of the bib intermediate the pocket and the oppositely facing concave edges of the bib.

BRIEF DESCRIPTION OF THE DRAWINGS

While the specification concludes with claims particularly pointing out and distinctly claiming the present invention, the invention will be better understood from the following description taken in conjunction with the accompanying drawings in which like designations are used to designate substantially identical elements, and in which:

DETAILED DESCRIPTION OF THE INVENTION

Figure 1:
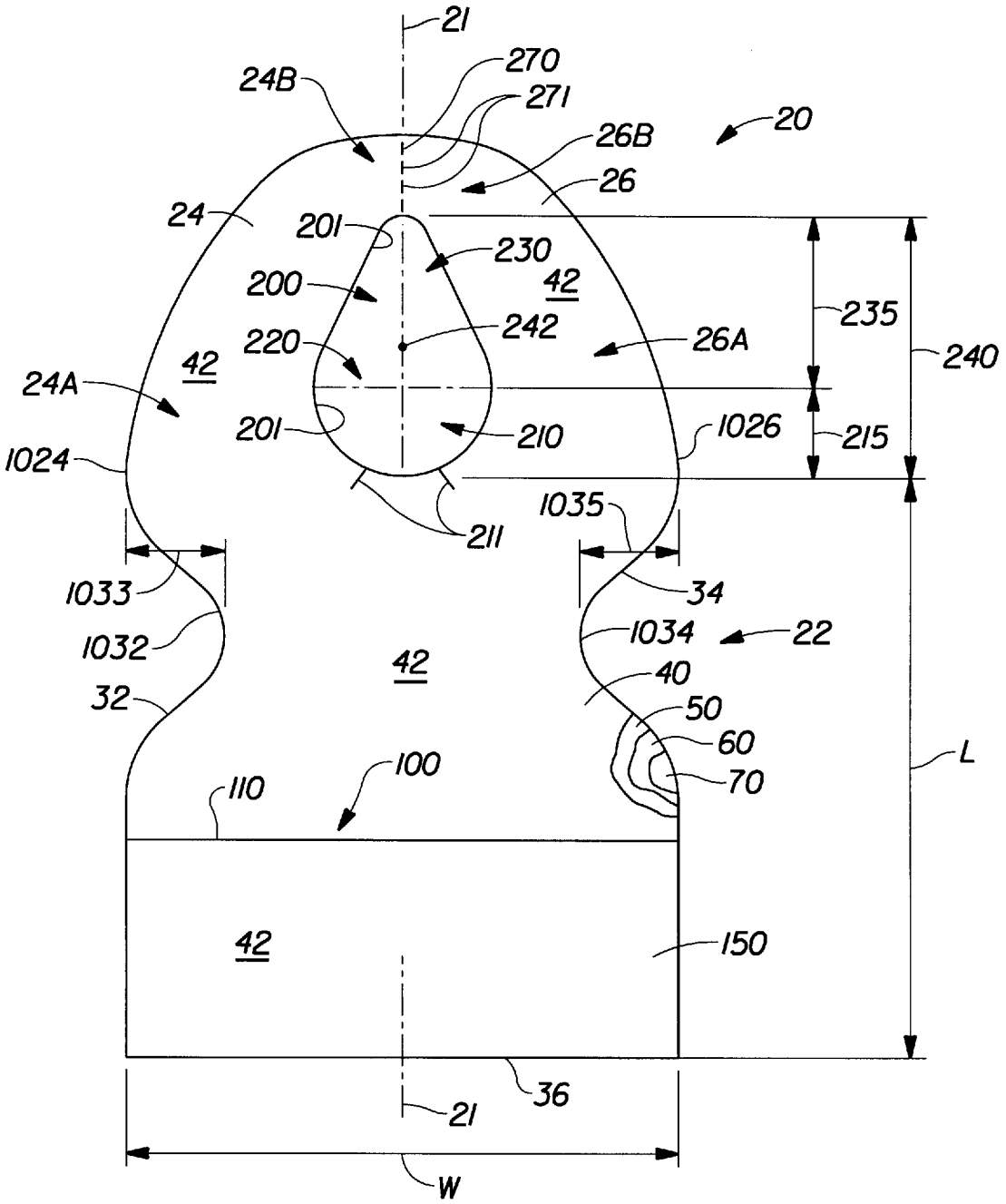
FIG. 1 is a front plan view of the disposable bib of the present invention wherein the bib is supported in a flat, generally planar orientation, and wherein the bib is shown partially cut away to illustrate layers of the bib.
Figure 2:
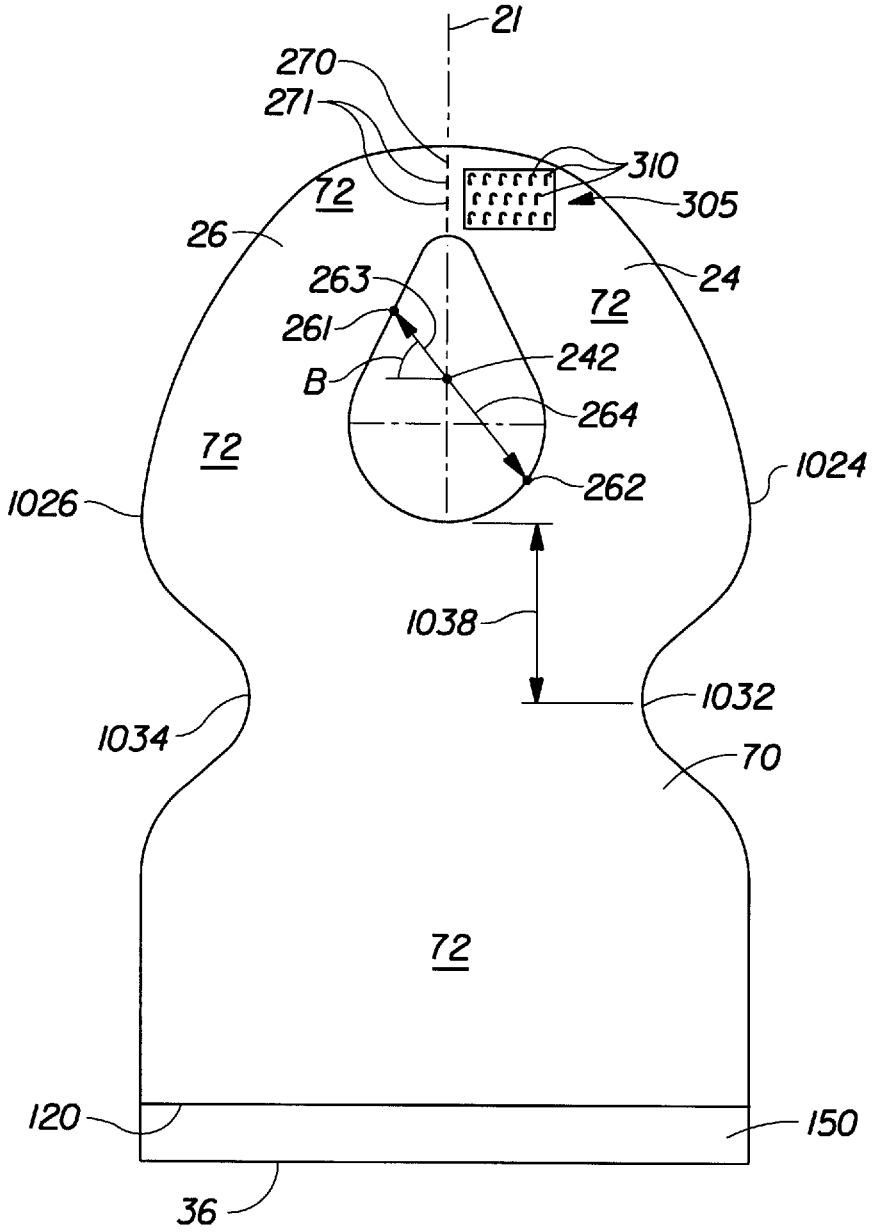
FIG. 2 is a rear plan view of a disposable bib of the present invention showing the body facing surface of the bib.

FIGS. 1–2 illustrate a disposable bib 20 according to one embodiment of the present invention. The bib 20 comprises a bib body 22 having longitudinally extending sides 32 and 34, a longitudinal length L, a longitudinal centerline 21, a laterally extending bottom edge 36, and a lateral width W. The term "longitudinal" refers to an axis or direction measured along the length of the bib body 22, which direction or axis is generally parallel to a line extending from the wearer's head to the wearer's waist, as the bib is worn. The terms "lateral" and "transverse" refer to an axis or direction which is perpendicular to the longitudinal centerline 21, and which is generally parallel to a line extending across the wearer's chest as the bib is worn.

The sides 32 and 34 include oppositely facing, laterally spaced apart concave edges 1032 and 1034. The concave edges 1032 and 1034 are positioned along the sides 32 and 34 to accommodate movement of the wearer's arms.

The bib 20 also comprises a pair of shoulder extensions 24, 26, each having a proximal end connected to the bib body 22 and a distal end spaced from the bib body 22. In FIG. 1, the proximal ends are designated 24A, 26A, and the distal ends of the shoulder extensions 24 and 26 are designated 24B and 26B. The distal ends 24B and 26B of the shoulder extensions are releasably joined together along a selective line of weakening 270 comprising perforations designated 271.

The shoulder extensions 24, 26 can extend from the bib body 22 such that the outward edges of the extensions 24, 26 provide at least a portion of a pair of oppositely facing, laterally spaced apart convex edges 1024 and 1026. The convex edge 1024 is adjacent to, and associated with the concave edge 1032. The convex edge 1026 is adjacent to, and associated with the concave edge 1034. The portions of the shoulder extensions 24 and 26 which are bordered by the edges 1024 and 1026 extend over the wearer's shoulders to protect the wearer's shoulders from being soiled.

The shoulder extensions 24, 26 also extend from the bib body 22 to provide a generally planar neck opening 200 when the bib is supported on a flat, horizontal surface. The generally planar neck opening 200 has a front neck portion 210, a rear neck portion 230, and a maximum width portion 220 disposed intermediate the front neck portion 210 and the rear neck portion 230. The neck opening 200 also has a longitudinal length 240 measured along the longitudinal centerline 21.

The generally planar neck opening 200 is generally symmetric about a longitudinal axis, such as the longitudinal centerline 21, and is generally asymmetric about a lateral axis passing through the midpoint 242 of the longitudinal length 240 when the bib is supported on a flat, horizontal surface. The lateral asymmetry of the neck opening 200 promotes fit about different neck sizes and shapes without slipping, while reducing the tendency of the bib body 22 to gap away from the wearer's chest when the shoulder extensions 24, 26 are overlapped behind the wearer's neck to fasten the bib to the wearer.

The bib 20 can also include a pocket 100 for catching and receiving food particles. The pocket 100 includes a pocket open edge 110 and a pocket bottom edge 120 (FIG. 2). In the embodiment shown, the bib 20 also includes an apron panel 150. The apron panel 150 can extend from the pocket open edge 110 to the bib bottom edge 36. The apron panel 150 can depend in a pendulous fashion from the pocket open edge 110 to provide gravitational opening of the pocket 100. U.S. Pat. No. 4,445,231 "Bib Having Gravitationally Openable Pocket" issued May 1, 1984 to Noel and U.S. patent application Ser. No. 08/513,496 "Bib Having an Improved Pocket" filed Aug. 10, 1995 in the name of Reinhart are incorporated herein by reference for the purpose of showing a bib construction for forming a bib having a pocket and an apron panel.

The bib 20 also preferably comprises a fastening assembly for joining together the shoulder extensions 24 and 26 in an overlapping fashion, to thereby secure the bib 20 to the wearer. The fastening assembly can comprise a mechanical fastener having elements disposed on the body facing surface of at least one of the shoulder extensions, which elements penetrate and physically engage a landing surface on the other shoulder extension. In FIG. 2, the fastener comprises an array 305 of projections 310 joined to the body facing surface of the shoulder extension 24, adjacent the distal end 24B of extension 24. The projections 310, which can be any suitable shape, including but not limited to hooks and prongs, are engagable with at least a portion of the outwardly facing surface of the shoulder extension 26. A suitable fastening assembly is disclosed in U.S. patent application Ser. No. 08/513,643 "Bib Having an Improved Neck Opening" filed Aug. 10, 1995 in the name of Reinhart, and U.S. patent application Ser. No. 08/667,155 "Bib Having an improved Fastener" filed Jun. 20, 1996 in the name of Reinhart, which applications are incorporated herein by reference. Alternatively, the fastening assembly can comprise an adhesive tape tab as disclosed in U.S. Pat. No. 4,523,333 to Spangler, which patent is incorporated herein by reference.

Referring to the components of the bib 20 in more detail, the bib 20 according to the present invention can comprise a composite construction having multiple laminae. The bib 20 in FIG. 1 is shown partially cut away to illustrate a laminate of four layers including: an outer nonwoven layer 40 having an outwardly facing surface 42; a tissue paper layer 50 disposed subjacent the nonwoven layer 40; a plastic film layer 60 disposed subjacent the paper layer 50; and a nonwoven body facing layer 70 disposed adjacent to the plastic film layer 60. The nonwoven body facing layer 70 has a body facing surface 72, as shown in FIG. 2.

The outwardly facing surface 42 of outer nonwoven 40 extends over at least a portion of the shoulder extension 26 and is engageable by the projections 310 extending from the body facing surface of shoulder extension 24. The layers 40, 50, 60, and 70 can be joined together in any suitable manner, such as with an adhesive. In one embodiment, the shoulder extensions 24, 26, the bib body 22, and the pocket 100 and the apron panel 150 can be formed from a single continuous sheet of the laminate of layers 40, 50, 60, and 70.

The nonwoven layers 40 and 70 can each comprise a nonwoven web of natural fibers, synthetic fibers, or combinations of natural and synthetic fibers. Each of the layers 40 and 70 can be a web of spunlaid, thermally point bonded polypropylene fibers, the web having a basis weight of about 22 grams per square meter and the fibers having an average denier less than or equal to about 3 grams per 9000 meter of fiber length. A suitable nonwoven web is manufactured by the Fiberweb Corp. of Simpsonville, S.C. under the designation Celestra Unicorn. Such a web of fibers provides a surface (e.g. surface 42) which can be securely engaged by the projections 310, and which is soft and nonabrasive to the wearer's skin.

The paper layer 50 can comprise a paper web having a basis weight of from about 10 to about 50 pounds per three thousand square feet. The following U.S. Patents are incorporated by reference for the purpose of disclosing how to make tissue paper suitable for use in the bib 20: U.S. Pat. Nos. 4,191,609; 4,440,597; 4,529,480; 4,637,859; 5,223,096; and 5,240,562. A suitable paper layer 50 can be formed from a single ply or multiple ply paper towel, such as a BOUNTY brand paper towel manufactured by The Procter and Gamble Company of Cincinnati, Ohio.

The plastic film layer 60 can be a liquid impervious polymeric film, such as a polyolefinic film. In one embodiment, the layer 60 can be a polyethylene film having a thickness of between about 0.0076 millimeter and about 0.0508 millimeter.

The generally planar neck opening 200 can have a closed shape, as shown in FIG. 1, or alternatively, can have an open, rearwardly converging shape. In either case, the maximum lateral width of the opening 200 is located in the maximum width portion 220 disposed intermediate the front and rear neck portions 210 and 230. The maximum width portion 220 is a line of maximum width in FIG. 1. Alternatively, the maximum width portion 220 could have a finite longitudinal length.

The length 240 is measured along the longitudinal centerline 21 between opposite points on the perimeter 201 of the opening 200. If the neck opening 200 has an open, rearwardly converging shape, the length 240 is measured along the longitudinal centerline 21 from the front neck opening portion 210 to position in the rear neck opening portion having the minimum lateral width (i.e. where the shoulder extensions 24 and 26 are closest together.)

The permiter 201 in the front neck opening portion 210 can have a shape which is generally concave with respect to the center of the neck opening (i.e. concave upward as the bib is worn) as shown in FIG. 1. In FIG. 1, the perimeter 201 is generally semicircular in the front neck opening portion 210. The perimeter 201 of the front neck portion 210 can comprise any number of commonly recognized geometric shapes, including but not limited to oval, circular, parabolic, or elliptical shapes. Alternatively, the perimeter of the front neck portion 210 could comprise one or more straight line segments, one or more curved segments, or a combination of straight line segments and curved segments.

A plurality of slits 211 can extend in a generally radial fashion from the perimeter 201 of the front neck opening portion 210. The slits 211 provide a close yet comfortable fit of the perimeter 210 of front neck opening portion 210 against the wearer's neck. The slits 211 allow the resulting petal like portions of bib intermediate the slits 211 to slide over each other as the shoulder extensions 24, 26 are overlapped. The slits 211 thereby help reduce distortion and gapping of the bib body as the neck opening 200 is made to conform to the wearer's neck. Accordingly, the slits 211 cooperate with the shape of the neck opening 200 to improve fit of the bib about the wearer's neck, and reduce distortion and gapping of the bib body as the shoulder extensions 24, 26 are overlapped to accommodate a particular neck size. Such slits, or bifurcations, are disclosed generally in U.S. Pat. No. 4,416,025 to Moret, which Patent is incorporated herein by reference.

The rear neck opening portion 230 can have a perimeter 201 comprising straight line segments, curved segments, or a combination of straight line segments and curved segments. In FIG. 1, the perimeter of the rear neck portion 230 comprises generally straight line segments defined by the inside edges of the shoulder extensions 24 and 26. These straight line segments are convergent, as the rear neck opening portion 230 extends from the maximum width portion 220, such that the rear neck opening portion 230 is tapered as it extends from the maximum width portion 220. The concave perimeter of the front neck opening portion 210 and the tapered rear neck opening portion 230 provide a teardrop shaped neck opening 200, as shown in FIG. 1.

The rear neck opening portion 230 can have a longitudinal length 235 which is greater than the longitudinal length 215 of the front neck opening portion 210, as shown in FIGS. 1. In one embodiment, the longitudinal length 235 is at least about 1.2 times, in another embodiment, at least about 1.5 times, and in still another embodiment, at least about 2.0 times the longitudinal length 215.

Bibs with shoulder extensions defining a circular neck opening when the bib is in a generally planar orientation will generally exhibit high distortion when the shoulder extensions are overlapped to fit necks significantly smaller than the diameter of the circular opening. Bibs having a neck opening with a laterally elongated oval shape (major axis oriented laterally) will also exhibit significant distortion as the shoulder extensions are overlapped to accommodate smaller neck sizes.

Bibs with shoulder extensions defining a longitudinally elongated oval shaped neck opening (major axis oriented longitudinally) when the bib is in a generally planar orientation can exhibit less distortion than bibs having laterally elongated openings. However, such a neck opening shape may act as a slot, allowing the bib to shift longitudinally relative to the wearer. Bibs having shoulder extensions defining a U or V-shaped neck opening when the bib is in a generally planar orientation can also exhibit excessive distortion when the shoulder extensions are overlapped, and can shift longitudinally.

The shoulder extensions 24 and 26 engage the rear portion of the wearer's neck at varying degrees of overlap to accommodate a wide arrange of neck sizes, while reducing the amount of distortion of the bib body 22 which would otherwise occur as the overlap is increased to accommodate relatively smaller neck sizes.

The generally planar neck opening 200 according to the present invention has a lateral asymmetry ratio greater than 1.0. In some embodiments, the ratio can be at least about 1.15, in other embodiments at least about 1.25, in yet other embodiments at least about 1.5. A bib opening 200 having longitudinal symmetry and a lateral asymmetry ratio greater than 1.0 provides the advantage that the perimeter 201 of the rear neck opening portion can engage the back portion of necks of various size with minimal distortion and gapping of the bib body 22. The lateral asymmetry ratio is measured using the following procedure (FIG. 2).

The bib 20 is supported on a flat, horizontal surface to provide a generally planar neck opening 200. A "generally planar neck opening 200" is provided when the shoulder extensions 24, 26 and the body 22 are in substantially the same plane and the shoulder extensions 24, 26 are in a non-overlapping configuration. The midpoint 242 of the length 240 is then located, such as with a ruler having its edge placed over the bib and along the centerline 21. The location of the midpoint can be marked on the flat, horizontal surface. An imaginary line is then constructed which extends through the midpoint 242 of the longitudinal length 240 of the neck opening and which intersects the perimeter 201 of the neck opening 200 at two points: a first intersection point 261 located on the perimeter of the rear neck portion 230 and a second intersection point 262 in an opposite portion of the perimeter of the neck opening (points 261, 262, and 242 are collinear). The location of point 261 is chosen so that the ratio of the distance 264 (measured from the midpoint 242 to the second point 262) to the distance 263 (measured from the midpoint 242 to the first point 261) is maximum. This ratio, obtained by dividing distance 264 by distance 263, is the asymmetry ratio of the neck opening 200.

In one embodiment the generally planar neck opening 200 has a lateral asymmetry ratio within a particular angular portion of the neck opening 200, as defined by an angle B (FIG. 2). It is desirable that the generally planar neck opening 200 have a lateral asymmetry ratio exceeding 1.0 within a particular angular portion of the neck opening so that the neck opening can securely engage the back portion of the wearer's neck with a component of force which prevents slipping or shifting of the bib relative to the wearer.

Referring to FIG. 2, angle B is measured from a lateral axis passing through midpoint 242. In one embodiment, the neck opening 200 has an asymmetry ratio of at least about 1.15, in another embodiment at least about 1.25, and in yet another embodiment at least about 1.5, wherein the asymmetry ratio is positioned within an angular portion of the neck opening defined by: 15 degrees <B<80 degrees, and more particularly, within an angular portion defined by 30 degrees<B<75 degrees.

Prior to the time the bib is to be used, the shoulder extensions 24 and 26 can be joined together, such as at their distal ends 24B, 26B, along a selective line of weakening 270. When the bib is to be used, the shoulder extensions are separable along the selective line of weakening 270, such that the shoulder extensions can be separated without tearing or otherwise damaging other portions of the bib, and releasably joined together in an overlapping fashion by the fastening assembly.

In one embodiment, the selective line of weakening 270 is aligned with the longitudinal centerline 21, and comprises a plurality of spaced apart perforations 271. The perforations 271 extend partially or fully through the thickness of the bib 200. The perforations can be formed with a perforating knife, and can extend through each layer of the bib.

The concave edges 1032 and 1034 are positioned longitudinally intermediate the neck opening 200 and the bottom edge 36. More particularly, the concave edge 1032 is disposed intermediate the convex edge 1024 and the pocket 100 along the side 32, and the concave edge 1034 is disposed intermediate the convex edge 1026 and the pocket 100 along the edge 34.

The lateral offset 1033 (FIG. 1) between concave edge 1032 and associated convex edge 1024 is preferably at least about 1.5 inches, more preferably at least about 1.75 inches, and most preferably at least about 2.0 inches. The lateral offset is the difference between the local minima and local maxima of the width of the bib associated with the edges 1032 and 1024, respectively. Similarly, the lateral offset 1035 is preferably at least about 1.5 inches, more preferably at least about 1.75 inches, and most preferably at least about 2.0 inches. The concave edge 1032 and the convex edge 1024, together, preferably combine to provide a continuous, smooth, sinusoidal-like portion of the side 32. Similarly, the concave edge 1034 and the convex edge 1026, together, preferably combine to provide a continuous, smooth, sinusoidal-like portion of the side 34.

In one embodiment, the maximum lateral width of the neck opening 200 can be less than or equal to about 4.0 inches, and can be between about 3.0 inches and about 4.0 inches. The longitudinal length 240 of the opening 200 can be at least about 4.0 inches, and can be between about 4.0 inches to about 5.0 inches. The lateral width of the bib as measured across the oppositely facing convex edges 1024 and 1026 can be at least about 11.0 inches, preferably at least about 11.75 inches; and the lateral width of the bib as measured across the oppositely facing concave edges 1032 and 1034 can be at least about 7.0 inches. The longitudinal spacing 1038 (FIG. 2) between the neck opening 200 and the oppositely facing concave edges 1032 and 1034 is at least about 2.5 inches, and is preferably between about 3.0 and about 3.5 inches.

Figure 3:
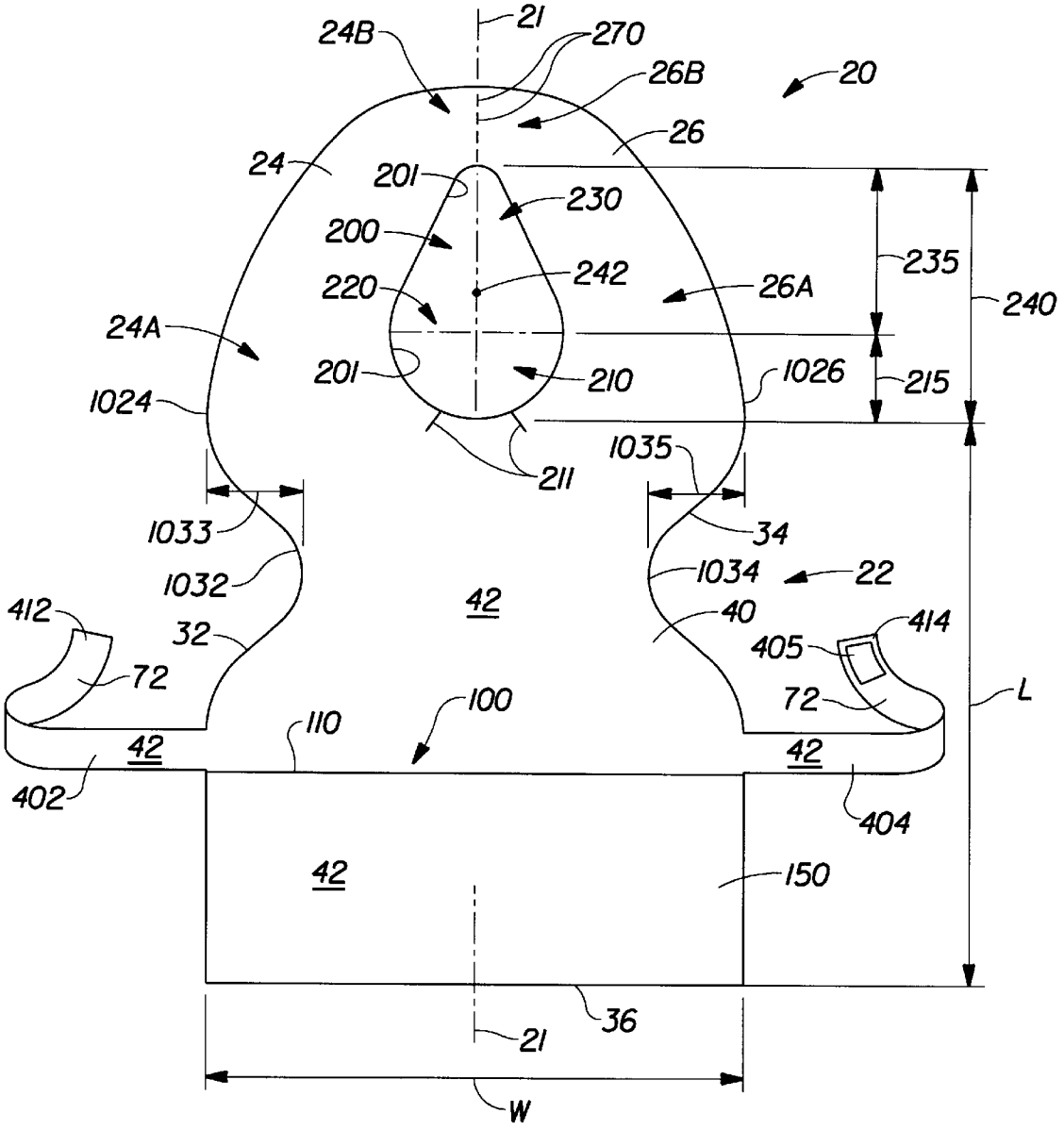
FIG. 3 is a front plan view of a disposable bib of the present invention having waist straps extending from each side of the bib.

In an alternative embodiment of the present invention shown in FIG. 3, the bib 20 includes at least one waist fastening member. In FIG. 3, the bib 20 includes a pair of waist fastening members comprising waist fastening straps 402 and 404 for securing the bib about the wearer's waist. Waist strap 402 extends from the side 32 of the bib to a distal strap end 412. Waist strap 402 extends from the side 32 intermediate the concave edge 1032 and the bottom edge 36. Similarly, waist strap 404 extends from the side 34 of the bib to a distal strap end 414.

Waist strap 404 extends from the side 34 intermediate the concave edge 1034 and the bottom edge 36. Preferably, the waist strap 402 extends from the side 32 intermediate the concave edge 1032 and the pocket 100, and the waist strap 404 extends from the side 34 intermediate the concave edge 1034 and the pocket 100. A mechanical fastener 405 can be joined to the body facing surface of the strap 404 adjacent the distal end 414. The mechanical fastener 405 can include projections, such as hooks or prongs, which engage the surface 42 of the strap 402 when the straps 402 and 404 encircle the wearer's waist. Alternatively, the strap 402 or the strap 404 can have a tape tab fastener (such as the tape tab fastener disclosed in above reference U.S. Pat. No. 4,523,333) associated with the strap distal edge.

Two waist fastening straps are shown in FIG. 3. Alternatively, a single waist fastening strap could extend from one of the sides, such as side 32. For instance, the single waist fastening strap could be of sufficient length to extend from the side 32, encircle the wearer, and be fastenable to the bib at or adjacent to the side 34.

In yet another embodiment, the bib 20 can include one or more waist fastening straps adapted to be elastically extensible such that a strap can be stretched to partially or completely encircle the wearer. For instance, a single strap such as strap 402 in FIG. 3 could be adapted to be elastically extensible in a direction perpendicular to the longitudinal centerline 21. U.S. Pat. No. 5,518,801 issued May 21, 1996 in the name of Chappell et al. is incorporated herein by reference for the purpose of disclosing web materials having elastic-like behavior.

Figure 4:
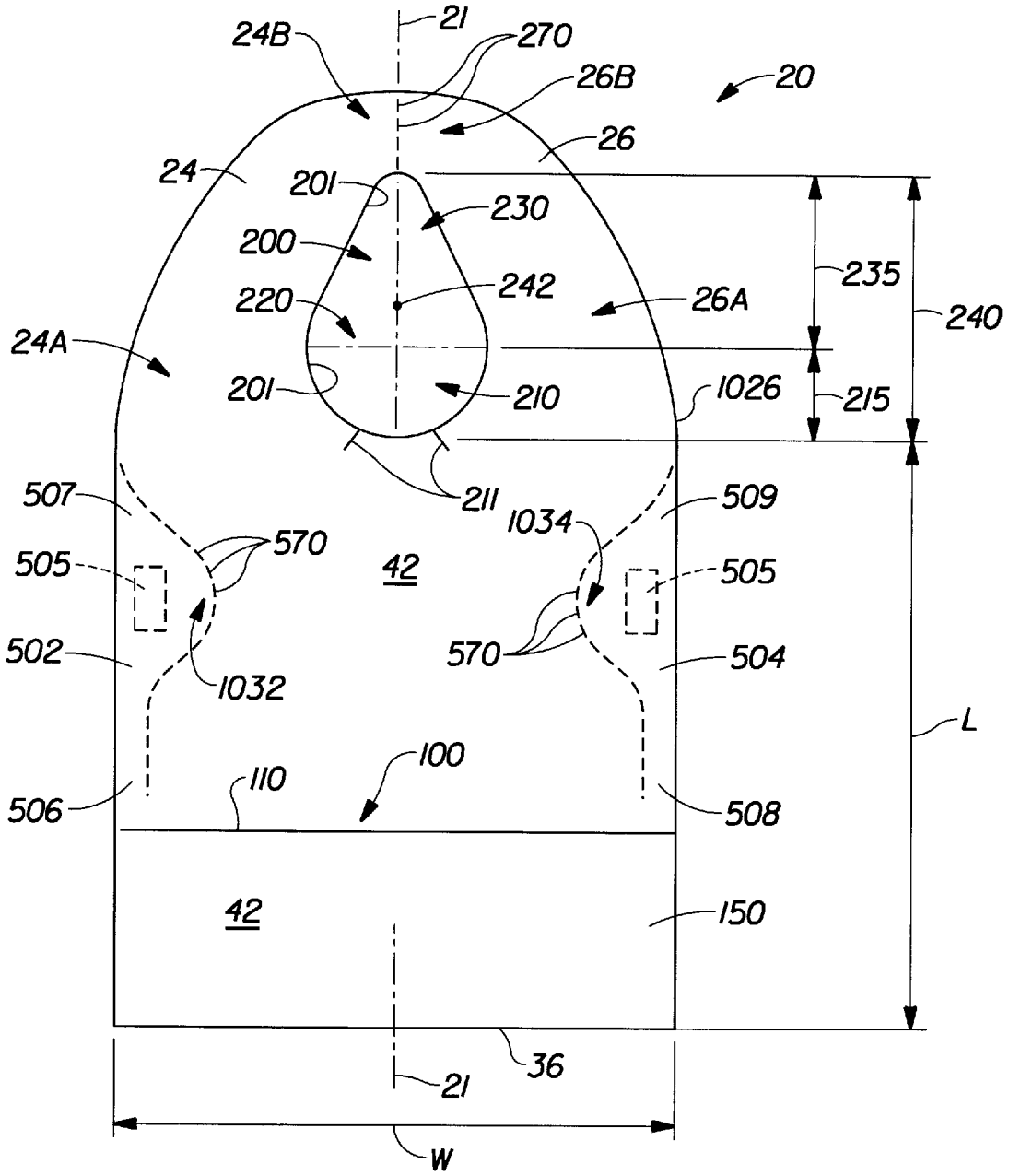
FIG. 4 is a front plan view of a disposable bib having fastening tabs separable from the sides of the bib along lines of perforations.

FIG. 4 illustrates a bib according another embodiment of the present invention, the bib having fastening members comprising tabs 502 and 504. A portion of tab 502, including distal tab end 507, is releasable attached to side 32 along a line of perforations 570. Similarly, a portion of tab 504, including distal tab end 509, is releasably attached to side 34 along a line of perforations 570. The proximal ends 506 and 508 of the tabs 502 and 504 remain permanently joined to the bib.

The tabs 502 and 504 are partially separated from the bib along the lines of perforations 570 to provide the oppositely facing concave edges 1032 and 1034. Each tab includes a fastener, such as a tape tab fastener 505 (shown in phantom in FIG. 4), joined to the layer 70 on the body facing surface of the tabs 502 and 504. The tape tab fasteners 505 can be used to secure the bib to the wearer's waist, thereby preventing shifting of the bib relative to the wearer's waist.

Alternatively, the bib 20 can comprise a waist fastening member which is releasably attached to a side of the bib along a line of perforations, wherein at least a portion of the the fastening member is adapted to be elastically extensible along one or more axis. For instance, at least a portion of one or both of the tabs 502 and 504 can be adapted according to the teachings of above referenced U.S. Pat. No. 5,518,801 to have elastic extensibility in a direction generally parallel to the longitudinal direction 21. Accordingly, when a tab such as tab 502 is separated along the line of perforations 570, the tab 502 can be stretched from a first length, corresponding to its length parallel to the centerline 21 when attached along the line of perforations 570, to a second, greater length. For instance, one tab 502 can be adapted to have sufficient extensibility to completely encircle the wearer. Alternatively, two tabs 502 and 504 can be adapted to have sufficient extensibility to partially encircle the wearer.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed:

1. A disposable bib comprising:

a bib body having a longitudinal length, a lateral width, a bottom edge, and laterally spaced apart sides, the sides comprising oppositely facing concave edges;

a pair of shoulder extensions extending from the bib body to provide a generally planar neck opening having a longitudinal length, at least one shoulder extension comprising a nonwoven outer surface;

wherein the generally planar neck opening has a front neck portion, a rear neck portion, and a maximum width portion disposed between the front neck portion and the rear neck portion, wherein the rear neck portion has a longitudinal length which is at least about 1.5 times greater than the longitudinal length of the front neck portion; and wherein the bib comprises a fastening assembly for releasably joining together the shoulder extensions in an overlapping fashion, the fastening assembly comprising projections extending from at least one shoulder extension, the projections being releasably engageable with a nonwoven outer surface on the other shoulder extension;

a pocket; wherein the oppositely facing concave edges are disposed intermediate the neck opening and the pocket, and a pair of waist fastening members, wherein each waist fastening member extends from a side of the bib intermediate the pocket and one of the concave edges of the bib.

2. The disposable bib of claim 1 wherein at least a portion of the waist fastening member is adapted to be elastically extensible.

3. A disposable bib comprising:

a bib body having a longitudinal length, a lateral width, a bottom edge, and laterally spaced apart sides, the laterally spaced apart sides comprising oppositely facing convex edges and oppositely facing concave edges;

a pair of shoulder extensions extending from the bib body to provide a generally planar neck opening having a longitudinal length;

wherein the generally planar neck opening has a front neck portion, a rear neck portion, and a maximum width portion disposed between the front neck portion and the rear neck portion, wherein the rear neck portion has a longitudinal length which is at least about 1.5 times greater than the longitudinal length of the front neck portion; and wherein the bib comprises a fastening assembly for releasably joining together the shoulder extensions in an overlapping fashion;

a pocket; wherein the oppositely facing concave edges are disposed intermediate the convex edges and the pocket, and a pair of waist fastening members, wherein each waist fastening member extends from a side of the bib intermediate the pocket and one of the concave edges of the bib.

4. The disposable bib of claim 3 wherein the lateral offset between the convex edges and the concave edges is at least about 1.5 inches.

5. A disposable bib comprising:

a bib body having a longitudinal length, a lateral width, a bottom edge, and laterally spaced apart sides, the sides comprising oppositely facing concave edges;

a pair of shoulder extensions extending from the bib body to provide a generally planar neck opening; wherein the generally planar neck opening has a front neck portion, a rear neck portion, and a maximum width portion disposed between the front neck portion and the rear neck portion, wherein the rear neck portion has a longitudinal length which is at least about 1.5 times greater than the longitudinal length of the front neck portion; and wherein the bib comprises a fastening assembly for releasably joining together the shoulder extensions in an overlapping fashion;

a pocket; wherein the oppositely facing concave edges are disposed intermediate the neck opening and the pocket, and a pair of waist fastening members, wherein each waist fastening member extends from a side of the bib intermediate the pocket and one of the concave edges of the bib.

6. The disposable bib of claim 5 wherein a portion of each waist fastening member is releasably attached to a side of the bib along a line of perforations.

7. The disposable bib of claim 6 wherein the waist fastening members are releasable from the sides of the bib to provide the oppositely facing concave edges.

8. The disposable bib of claim 5 wherein the waist fastening members comprise waist straps adapted to encircle the wearer.

9. The disposable bib of claim 5 wherein the waist fastening members comprise tabs extending from opposite sides of the bib body, and wherein each tab comprises an adhesive fastener.

* * * * *